US007866062B2

(12) United States Patent
Yang

(10) Patent No.: US 7,866,062 B2
(45) Date of Patent: Jan. 11, 2011

(54) FOOTWEAR SEPARABLE TO TWO PIECE

(75) Inventor: Jang Sik Yang, Busan (KR)

(73) Assignee: Sungshin New Material Co., Ltd. (KR)

( * ) Notice: Subject to any disclaimer, the term of this patent is extended or adjusted under 35 U.S.C. 154(b) by 915 days.

(21) Appl. No.: 11/577,269

(22) PCT Filed: Oct. 12, 2005

(86) PCT No.: PCT/KR2005/003391

§ 371 (c)(1),
(2), (4) Date: Apr. 13, 2007

(87) PCT Pub. No.: WO2006/080752

PCT Pub. Date: Aug. 3, 2006

(65) Prior Publication Data

US 2007/0245593 A1 Oct. 25, 2007

(30) Foreign Application Priority Data

Oct. 13, 2004 (KR) ..... 20-2004-0028971 U

(51) Int. Cl.
*A43B 13/20* (2006.01)

(52) U.S. Cl. ..... 36/3 R; 36/3 B; 36/28; 36/100

(58) Field of Classification Search ..... 36/28, 36/37, 35 R, 3 R, 3 B, 100
See application file for complete search history.

(56) References Cited

U.S. PATENT DOCUMENTS

| | | | | |
|---|---|---|---|---|
| 5,325,611 | A * | 7/1994 | Dyer et al. | 36/30 R |
| 5,469,639 | A * | 11/1995 | Sessa | 36/28 |
| 6,014,821 | A * | 1/2000 | Yaw | 36/8.1 |
| 6,691,432 | B2 * | 2/2004 | Masseron | 36/28 |
| 6,701,640 | B2 * | 3/2004 | Nakano | 36/8.1 |
| 7,000,334 | B2 * | 2/2006 | Gillespie | 36/28 |
| 7,426,792 | B2 * | 9/2008 | Swigart et al. | 36/28 |

* cited by examiner

*Primary Examiner*—Marie Patterson
(74) *Attorney, Agent, or Firm*—Park & Associates IP Law LLC

(57) ABSTRACT

Disclosed herein is footwear separable into two pieces in which an insertion body is adapted to be fit into an insertion recess formed at the heel portion of a footwear body, for absorbing the impact applied to a wearer upon walking, thus to achieve better wearing effect, the insertion body is freely assembled with and separated from the footwear body, thus to form a variety of designs thereon, the insertion recess has a drain hole connected from the bottom portion thereof to the corresponding bottom portion of the footwear body, thus to prevent water from gathering into the insertion recess, and if the footwear body is formed of a polyurethane material, the insertion body is formed of an ethyl-vinyl acetate (EVA) material, and vice versa, thus to provide high flexibility to the footwear, which makes the wearer feel comfortable.

7 Claims, 1 Drawing Sheet

[Fig. 1]
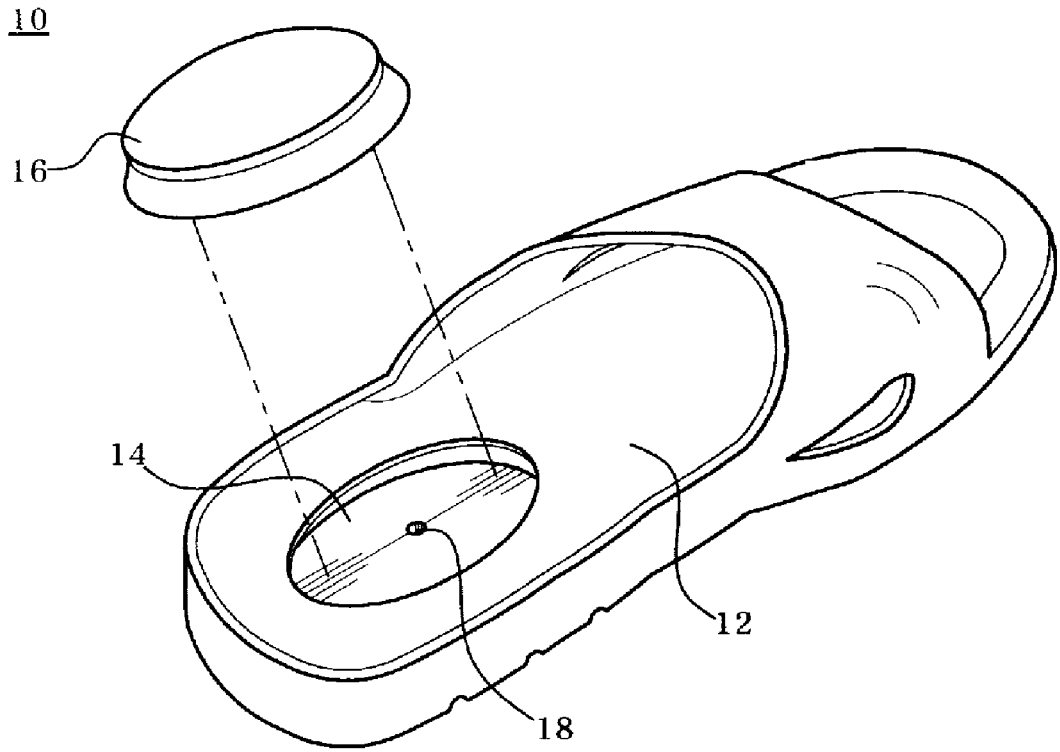
[Fig. 2]
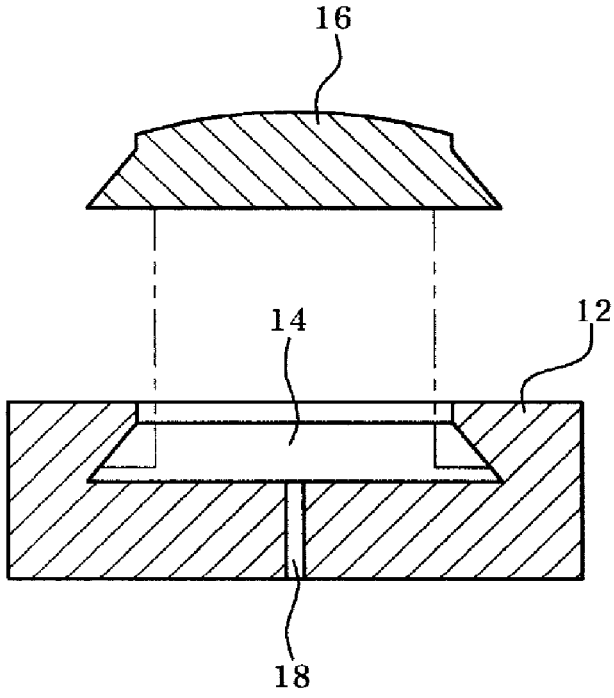

FOOTWEAR SEPARABLE TO TWO PIECE

REFERENCE TO RELATED APPLICATIONS

This is a 371 of International Patent Application PCT/KR2005/003391 filed on Oct. 12, 2005, which designates the United States and claims priority of Korean Patent Application No. 20-2004-0028971 filed on Oct. 13, 2004.

FIELD OF THE INVENTION

The present invention relates to a footwear separable into two pieces having a variety of colors, weights, and hardnesses, and more particularly, to a footwear separable into two pieces in which an insertion body is adapted to be fit into an insertion recess formed at the heel portion of a footwear body, for absorbing the impact applied to a wearer upon walking, thus to achieve better wearing effect, the insertion body is freely assembled with and separated from the footwear body, thus to form a variety of designs thereon, the insertion recess has a drain hole connected from the bottom portion thereof to the corresponding bottom portion of the footwear body, thus to prevent water from gathering into the insertion recess, and if the footwear body is formed of a polyurethane material, the insertion body is formed of an ethyl-vinyl acetate (EVA) material, and vice versa, thus to provide high flexibility to the footwear, which makes the wearer feel comfortable.

BACKGROUND OF THE INVENTION

Generally, when a person stands or walks, his or her weight gathers to the heel portion of his or her foot. Thus, after a wearer stands or walks for lots of hours, he or she becomes much fatigued due to the load applied to his or her heel portion. Particularly, when a person having arthritis or diabetes walks, he or she may feel easily tired or pain by the shock applied through the heel portion. The type of conventional footwear is provided with an air cushion for absorbing the shock applied to the heel portion of a wearer's foot. Up to now, however, there is no shock-absorbing means for slippers.

SUMMARY OF THE INVENTION

Accordingly, the present invention has been made to solve the above-mentioned problems occurring in the prior art, and it is an object of the present invention to provide a footwear separable into two pieces in which an insertion body is adapted to be fit into an insertion recess formed at the sole, in particular at the heel portion of a footwear body, for absorbing the impact applied to a wearer upon walking, thus to achieve better wearing effect.

It is another object of the present invention to provide a footwear separable into two pieces in which an insertion body is freely assembled with and separated from a footwear body, thus to form a variety of designs thereon, and an insertion recess has a drain hole connected from the bottom portion thereof to the corresponding bottom portion of the footwear body, thus to prevent water from gathering into the insertion recess.

It is yet another object of the present invention to provide a footwear separable into two pieces in which if a footwear body is formed of a polyurethane material, an insertion body is formed of an ethyl-vinyl acetate (EVA) material, and vice versa, thus to provide high flexibility to the footwear, which makes the wearer feel comfortable.

To accomplish the above objects of the present invention, according to the present invention, there is provided a footwear separable into two pieces having a variety of colors, weights, and hardnesses, the footwear including a footwear body having an insertion recess formed at a heel portion thereof and an insertion body adapted to be fit to the insertion recess of the footwear body in such a manner as to be separable from the footwear body, for absorbing impact applied to a wearer's heel portion.

Preferably, the insertion recess may have a drain hole formed on the bottom portion thereof to the corresponding bottom portion of the footwear body, for preventing water from gathering therein.

Preferably, the insertion body may be formed of an EVA material, for providing good wearing effect to a wearer.

Preferably, the insertion body may be tapered such that the bottom surface thereof becomes larger than the top surface thereof.

The footwear separable into two pieces is provided with an insertion body is adapted to be fit into an insertion recess formed at the heel portion of a footwear body, for absorbing the impact applied to a wearer upon walking, thus to achieve better wearing effect.

Moreover, the footwear separable into two pieces is provided with the insertion body is freely assembled with and separated from the footwear body, thus to form a variety of designs thereon, and with the insertion recess having a drain hole connected from the bottom portion thereof to the corresponding bottom portion of the footwear body, thus to prevent water from gathering into the insertion recess.

Furthermore, the footwear separable into two pieces is provided with the footwear body formed of a polyurethane material and the insertion body formed of an EVA material, and vice versa, thus to provide high flexibility to the footwear, which makes a wearer feel comfortable.

BRIEF DESCRIPTION OF THE DRAWINGS

Further objects and advantages of the invention can be more fully understood from the following detailed description taken in conunction with the accompanying drawings in which:

FIG. 1 is a separated perspective view showing a footwear separable into two pieces according to a preferred embodiment of the present invention; and FIG. 2 is a sectional view of the footwear separable into two pieces of this invention.

DETAILED DESCRIPTION OF THE INVENTION

Now, an explanation on a preferred embodiment of the present invention will be in detail given with reference to attached drawings.

FIG. 1 is a separated perspective view showing a footwear separable into two pieces according to a preferred embodiment of the present invention. As shown in FIG. 1, the footwear separable into two pieces of this invention includes a footwear body 12 having an insertion recess 14 formed at a heel portion thereof and an insertion body 16 adapted to be fit to the insertion recess 14 of the footwear body 12 in such a manner as to be separable from the footwear body 12, for absorbing impact applied to a wearer's heel portion.

When a person stands or walks, his or her weight gathers to the heel portion of his or her foot. Thus, after a wearer stands or walks for lots of hours, he or she becomes much fatigued due to the load applied to his or her heel portion, and particularly, when a wearer having arthritis or diabetes walks, he or she may feel easily tired or pain by the shock applied through the heel portion. Therefore, the footwear body 12 is formed of a polyurethane material, and the insertion body 16 is formed of an EVA material, such that the footwear body 12 can maintain its original shape, while the insertion body 16 is being varied freely and flexibly in the original shape according to a wearer's weight gathering to the his or her heel portion, thereby absorbing the impact applied to the wearer's heel portion.

The insertion body 16 is freely assembled with and separated from the footwear body 12, such that it may have a variety of materials or designs and thus, it can be replaced with desired one according to the preference of a wearer. In the same manner as above, the footwear body 12 may be formed of a material having a different level of hardness from the insertion body 16. Generally, the footwear body 12 and the insertion body 16 are made of a polyurethane or EVA material.

FIG. 2 is a sectional view of the footwear separable into two pieces of this invention. As shown, the insertion recess 14 and the insertion body 16 are tapered such that the bottom surfaces thereof become relatively larger than the top surfaces thereof. This enables the insertion body 16 to be tightly fit to the insertion recess 14, without any separation from the footwear body 12.

That is to say, as the insertion body 16 is made of a relatively soft EVA material, preferably, it is not easily separated from the footwear body 12 at a normal state and readily separated from the footwear body 12 at a time of pulling out by a wearer's hand.

Moreover, the insertion body 16 is formed having a variety of colors or designs and thus replaced with desired one according to the preference of a wearer.

Furthermore, the insertion recess 14 has a drain hole 18 formed therein. In case of a footwear like sandals or slippers having the footwear body 12 opened to the outside, rain water may flow through a clearance between the insertion body 16 and the footwear body 12. At this time, the drain hole 18 is formed at a predetermined position of the bottom portion of the insertion recess 14, such that the water is not collected into the insertion recess 14, but discharged through the bottom portion of the footwear body 12 connected to the drain hole 18. This prevents odor or fur from remaining in the footwear, thereby maintaining a clean state during the usage.

The footwear of this invention is basically applied to sandals or slippers where the footwear body and the insertion body can be easily assembled with and separated from each other, and may be applied to other kinds of footwear.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

INDUSTRIAL APPLICABILITY

The present invention provides a footwear separable into two pieces where an insertion body is inserted into an insertion recess formed at a heel portion of the footwear like, especially, slippers, thereby reducing the impact applied strongly to a wearer's heel portion. The footwear of this invention is made of a plastic material such as a foamed polyurethane resin and an EVA resin.

What is claimed is:

1. A footwear and separable into two pieces, the footwear comprising:

a footwear body having an insertion recess formed on an upper surface at a sole portion thereof, the insertion recess having a drain hole formed on the bottom portion thereof for preventing water from gathering in the insertion recess by draining through the drain hole, the footwear body made of a first plastic material; and an insertion body adapted to fit to the insertion recess of the footwear body in such a manner as to be separable from the footwear body, for absorbing impact to a wearer's sole portion, the insertion body being tapered such that the bottom surface thereof becomes larger than the top surface thereof and made of a second plastic material which is softer than the first plastic material, the top surface of the insertion body having a convex surface contour with a central area thereof protruding upwardly from the upper surface of the footwear body so as to further facilitate absorption of the impact to the wear's sole portion.

2. The footwear according to claim 1, wherein the insertion recess is formed at a heel portion of the footwear body, and the second plastic material is EVA (ethylene-vinyl acetate) or polyurethane material.

3. The footwear according to claim 1, wherein the insertion recess and the insertion body each have a circular or oval shape.

4. The footwear according to claim 3, wherein the footwear is a sandal or slipper.

5. A footwear in the form of sandal or slipper and separable into two pieces, the footwear comprising:

a footwear body having a shape of sandal or slipper, the footwear body including an insertion recess of generally circular or oval shape formed on an upper surface at a sole portion thereof, the insertion recess having a drain hole formed on the bottom portion thereof for preventing water from gathering in the insertion recess by draining through the drain hole, the footwear body made of a first plastic material; and an insertion body of generally circular or oval shape adapted to fit to the insertion recess of the footwear body in such a manner as to be separable from the footwear body, for absorbing impact to a wearer's sole portion, the insertion body being tapered such that the bottom surface thereof becomes larger than the top surface thereof and made of a second plastic material softer than the first plastic material, the top surface of the insertion body having a convex surface contour with a central area thereof protruding upwardly from the upper surface of the footwear body so as to further facilitate absorption of the impact to the wear's sole portion.

6. The footwear according to claim 5, wherein the footwear is formed of two pieces, namely the footwear body and the insertion body.

7. The footwear according to claim 5, wherein the first plastic material is a polyurethane material and the second plastic material is EVA (ethylene-vinyl acetate).

* * * * *